US011718458B2

(12) United States Patent
Benson et al.

(10) Patent No.: US 11,718,458 B2
(45) Date of Patent: Aug. 8, 2023

(54) BIODEGRADABLE FASTENER

(71) Applicant: Twist-Ease, Inc., Crystal, MN (US)

(72) Inventors: David J. Benson, Stillwater, MN (US); James R. Helseth, Plymouth, MN (US)

(73) Assignee: Twist-Ease, Inc., Crystal, MN (US)

( * ) Notice: Subject to any disclaimer, the term of this patent is extended or adjusted under 35 U.S.C. 154(b) by 356 days.

(21) Appl. No.: 16/942,943

(22) Filed: Jul. 30, 2020

(65) Prior Publication Data

US 2021/0031995 A1 Feb. 4, 2021

Related U.S. Application Data

(60) Provisional application No. 62/880,765, filed on Jul. 31, 2019.

(51) Int. Cl.
*B65D 63/12* (2006.01)
*B65D 65/46* (2006.01)
*B65D 63/10* (2006.01)

(52) U.S. Cl.
CPC ..... *B65D 63/12* (2013.01); *B65D 63/1018* (2013.01); *B65D 65/466* (2013.01); *B65D 2563/101* (2013.01)

(58) Field of Classification Search
CPC ..... B65D 63/1018; B65D 63/12; B65D 2563/101; B65D 65/466; Y10T 24/157
See application file for complete search history.

(56) References Cited

U.S. PATENT DOCUMENTS 628,642 A 7/1899 Wyman
740,001 A 9/1903 Flanagin
1,053,126 A * 2/1913 Fuller et al. ..... F16M 11/04 248/440.1
1,441,359 A 1/1923 Langston
1,926,359 A * 9/1933 Rolliea ..... B65D 75/52 229/87.09
2,050,394 A 8/1936 Straubel
D156,922 S 1/1950 Sonntag
2,973,597 A 3/1961 Powell
2,984,161 A 5/1961 Cook et al.
3,068,135 A 12/1962 Bower
3,207,564 A 9/1965 Patrick et al.
3,290,854 A * 12/1966 McMurray ..... B65D 63/10 24/30.5 T
3,409,948 A 11/1968 Goodwin
(Continued)

FOREIGN PATENT DOCUMENTS

WO 2005/035381 A1 4/2005

OTHER PUBLICATIONS

International Search Report and Written Opinion for Application No. PCT/US2017/022138 dated Jul. 6, 2017.
(Continued)

*Primary Examiner* — Robert Sandy
*Assistant Examiner* — Louis A Mercado
(74) *Attorney, Agent, or Firm* — Merchant & Gould P.C.

(57) ABSTRACT

A fastener includes an elongate body defined by a first end, a second end, a first side portion, and a second side portion. The elongate body includes a plurality of discrete slits along at least the first side portion, and the plurality of slits extend at least partially into the elongate body of the fastener. The elongate body of the fastener includes a biodegradable material.

14 Claims, 6 Drawing Sheets

(56) References Cited

U.S. PATENT DOCUMENTS

| | | | | |
|---|---|---|---|---|
| 3,774,755 | A | 11/1973 | Cast et al. | |
| 3,833,972 | A * | 9/1974 | Brumlik | A44B 18/0015 24/449 |
| 3,914,823 | A | 10/1975 | Hara | |
| 3,918,129 | A | 11/1975 | Hara | |
| 3,943,607 | A | 3/1976 | Hara | |
| 3,973,294 | A | 8/1976 | Pfizenmaier | |
| 4,052,886 | A | 10/1977 | Buick | |
| D261,452 | S | 10/1981 | Chandler | |
| 4,509,231 | A | 4/1985 | Paxton | |
| 4,529,636 | A | 7/1985 | Olsen | |
| 4,537,330 | A | 8/1985 | Gelbard | |
| 4,543,862 | A | 10/1985 | Levene et al. | |
| 4,558,813 | A | 12/1985 | Richards | |
| 4,596,195 | A | 6/1986 | Wenger | |
| D285,719 | S | 9/1986 | Conlon | |
| 4,621,732 | A | 11/1986 | Olson | |
| D294,908 | S | 3/1988 | Childress | |
| 4,815,610 | A | 3/1989 | Borick et al. | |
| 4,915,996 | A | 4/1990 | Curry | |
| 4,948,202 | A | 8/1990 | Helseth | |
| 5,079,803 | A * | 1/1992 | Moore | B65D 63/1018 24/17 A |
| D323,594 | S | 2/1992 | Helseth | |
| 5,092,830 | A | 3/1992 | Helseth | |
| 5,213,400 | A | 5/1993 | Helseth | |
| 5,232,431 | A | 8/1993 | Helseth | |
| 5,234,615 | A * | 8/1993 | Gladfelter | A47L 15/4436 510/293 |
| 5,468,523 | A * | 11/1995 | Huss | D04D 11/00 428/101 |
| 5,614,274 | A * | 3/1997 | Huss | D04D 7/10 223/46 |
| 5,732,495 | A | 3/1998 | Lowe et al. | |
| D395,566 | S | 6/1998 | Helseth | |
| 5,871,115 | A | 2/1999 | Kohn | |
| 5,961,434 | A | 10/1999 | Helseth | |
| 6,217,500 | B1 | 4/2001 | Helseth et al. | |
| D496,860 | S * | 10/2004 | Mametja | D9/713 |
| D513,974 | S * | 1/2006 | Cheung | D8/396 |
| 8,176,599 | B2 * | 5/2012 | Rome | B65D 63/1018 24/17 AP |
| 10,538,372 | B2 | 1/2020 | Helseth | |
| 10,542,830 | B2 * | 1/2020 | Helseth | B65D 73/0028 |
| 11,214,420 | B2 * | 1/2022 | Helseth | B65D 83/02 |
| 11,453,538 | B2 * | 9/2022 | Durham | B26D 3/003 |
| 2007/0006426 | A1 | 1/2007 | Fukuyasu et al. | |
| 2010/0146743 | A1 | 6/2010 | Rome | |
| 2010/0310834 | A1 | 12/2010 | Buselli | |
| 2015/0034513 | A1 | 2/2015 | Helseth | |
| 2017/0112297 | A1 | 4/2017 | Helseth et al. | |

OTHER PUBLICATIONS

International Search Report and Written Opinion for PCT Application No. PCT/US2020/044194, dated Oct. 20, 2020, 13 pages.

* cited by examiner

BIODEGRADABLE FASTENER

CROSS-REFERENCE TO RELATED APPLICATION

The present application claims the benefit of U.S. Provisional Patent Application Ser. No. 62/880,765, filed Jul. 31, 2019, which application is hereby incorporated by reference in its entirety.

TECHNICAL FIELD

The present disclosure relates generally to fasteners, such as twist-tie fasteners and methods of manufacture.

BACKGROUND

In grocery stores and other locations where produce and other types of food are placed in bags for containment and carrying, generally a closure device is provided in order to temporarily close or seal the bag such that spillage of the contents does not occur. Typically, the closure device is either a twist-tie or a plastic lock device of the type manufactured by the Kwic-lok Company of Yakima, Wash.

Generally, a twist-tie is comprised of a length of wire embedded in a paper or plastic strip. The wire strength is such that the device may be easily looped about the open end of a bag or other object requiring closure or retention, and the wire may then be twisted about itself. The paper or plastic wrapping serves the function of protecting the user of the device from sharp wire ends, facilitating ease of fastening and unfastening the device, and generally sealing the metal wire therein.

Improvements in such twist-tie closure devices are desired, especially in an environment where a large number of people utilize such ties, and for disposal reasons.

SUMMARY

The following summary is made by way of example and not by way of limitation. It is merely provided to aid the reader in understanding some of the aspects of the inventive features.

In one embodiment, the fastener includes an elongate body having a first side portion and a second side portion. The fastener also includes a plurality of discrete slits along a first side portion of the elongate body, the plurality of discrete slits extending at least partially into the elongate body of the fastener.

In another embodiment, a cluster of fasteners is provided. The cluster of fasteners includes a plurality of fasteners defining the cluster. Each fastener includes an elongate body having a first side portion and a second side portion. The fastener also includes a plurality of discrete slits along a first side portion of the elongate body, the plurality of discrete slits extending at least partially into the elongate body of the fastener. Each of the plurality of fasteners is connected at a first end.

In yet another embodiment, a method of arranging fasteners into a cluster is described. The method includes providing one or more sheet(s) of fasteners, each sheet comprising a biocompatible material. The sheet of fasteners is cut into parallel lines, the parallel lines are spaced apart to define a width of an elongate body of the fastener. A plurality of slits are cut along a first side portion of the elongate body of each of the fasteners, the slits extending in a direction of from 1 to 90 degrees relative to the parallel lines, and the plurality of slits spaced apart from each other. The first end of the sheet of fasteners is connected to a first end of a second sheet of fasteners to provide overlaying layers of fasteners.

In certain other examples, for ease of manufacture, the plurality of slits on a second side portion of a first fastener may line up with (or extend into) the plurality of slits on a first side portion of a second adjacently positioned fastener.

BRIEF DESCRIPTION OF THE DRAWINGS

The inventive aspects of the present disclosure can be more easily understood, and further advantages and uses thereof can be more readily apparent, when considered in view of the detailed description and the following Figures in which.

In accordance with common practice, the various described features may not be drawn to scale but are drawn to emphasize specific inventive features relevant to the present disclosure. Reference characters denote like elements throughout the figures and the text.

DETAILED DESCRIPTION

In the following detailed description, reference is made to the accompanying drawings, which form a part hereof, and in which is shown by way of illustration, embodiments in which the inventions may be practiced. These embodiments are described in sufficient detail to enable those skilled in the art to practice the inventive features, and it is to be understood that other embodiments may be utilized and mechanical changes may be made without departing from the spirit and scope of the present disclosure. The following detailed description is, therefore, not to be taken in a limiting sense, and the scope of the present inventive features are defined only by the claims and equivalents thereof.

Embodiments of the present disclosure provide improved fasteners, for example, twist-tie fasteners. Generally, a fastener includes an elongate body having first and second ends and first and second side portions. The fastener has a plurality of discrete slits along at least the first side portion that extend partially into the elongate body of the fastener.

The fasteners can be used to temporarily close or seal a bag such that the contents stay in the bag. The plurality of discrete slits are formed such that when the elongate body of the fastener is twisted around itself, the slits catch each other and form a locking configuration.

Figure 1:
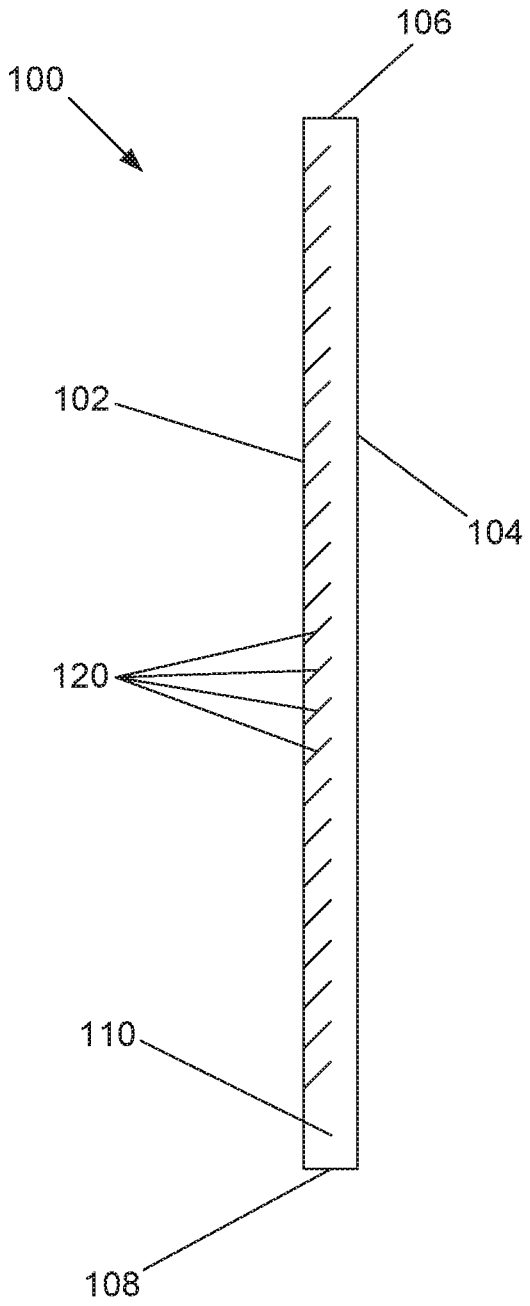
FIG. 1 illustrates an example embodiment of a fastener having features that are examples of inventive aspects in accordance with the present disclosure.

A first embodiment of a fastener 100 having features that are examples of inventive aspects is illustrated in FIG. 1. Fastener 100 includes a first end 106 and a second end 108 and a first side portion 102 and a second side portion 104 connected via a fastener body 110. The fastener body 110 is planar and generally rectangular in shape. Fastener 100 also includes a plurality of slits 120 that make up a locking portion.

As shown in FIG. 1, the plurality of slits 120 extend along the first side portion 102 from an edge of the fastener 100 toward a middle of the fastener body 110. The plurality of slits begin at first end 106 and continue to the second end 108. The plurality of slits 120 need not extend all the way from the first end 106 to the second end 108, but preferably extend at least along a middle portion between the first end 106 and the second end 108. The plurality of slits 120 extend along a first side portion 102 in FIG. 1. However, different embodiments of a fastener 100 (with different types of slits) are shown in FIGS. 2*a*-2*d*.

As shown in FIG. 1, a plurality of slits 120 may extend in a non-parallel direction with reference to a length of the fastener 100, for example, a diagonal direction relative to the first side portion 102. In other embodiments, the plurality of slits 120 may extend in different directions, such as perpendicular to the edge of the first side portion 102. The plurality of slits 120 extend at an angle greater than 0 degrees but less than 90 degrees to the length of the elongate body. In an embodiment, the plurality of slits 120 extends at an angle of 45 degrees relative to the first side portion 102.

In an example embodiment of a fastener 100 having the plurality of slits 120 extending only on the first side, the plurality of slits 120 extend into the fastener body 110 to a mid-line of the fastener body 110. In an embodiment of the fastener 100 having a plurality of slits 120 extending on both the first side portion 102 and the second side portion 104, the plurality of fasteners do not extend to a mid-line of the fastener body 110.

The plurality of slits 120 may function to replace a malleable material, such as a wire in a standard twist-tie. As discussed in detail below, the plurality of slits 120 interlock together, similar to when a twist-tie with a wire is twisted around itself. The plurality of slits 120 maintain the fastener 100 in a locked configuration, as to keep the bag closed.

The length of the fastener 100 may be about 4 inches and the width of a fastener 100 may be about ⅛ of an inch. However, longer or shorter fasteners 100 may be desired for specific applications, and wider or narrower fasteners 100 may be desired for specific applications.

Figures 2A, 2B, 2C, 2D:
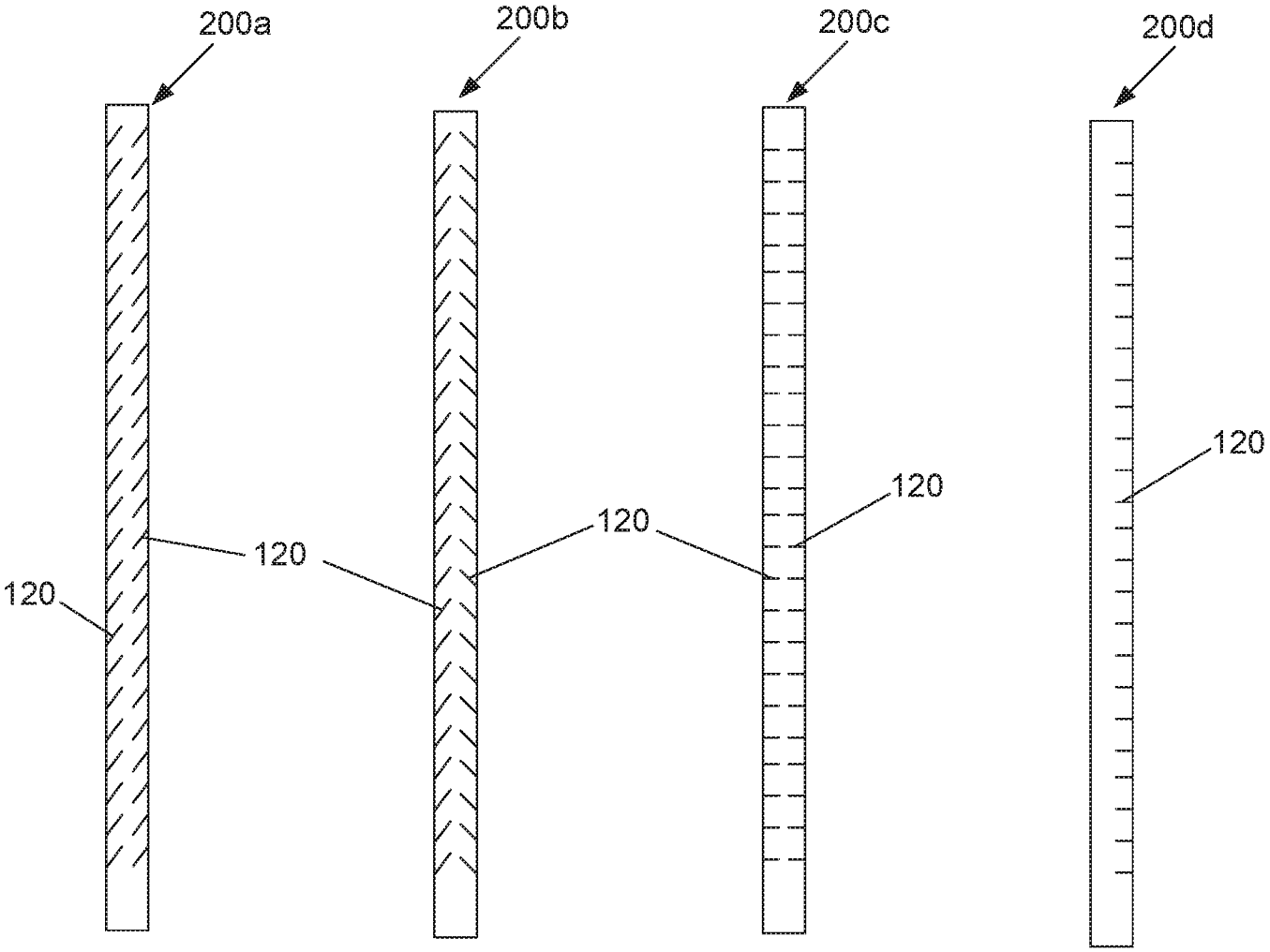
FIGS. 2*a-d* illustrate alternative embodiments of the fastener of FIG. 1, showing the different types of slits that may be utilized.

FIGS. 2*a*-2*d* illustrate example alternative embodiments of fasteners 200*a*, 200*b* 200*c*, 200*d*. As shown in FIG. 2*a*, a plurality of slits 120 extend along a first side portion 102 and a second side portion 104 of a fastener 200*a*. Further, the plurality of slits 120 extend in the same direction; however, the plurality of slits 120 on each side portion do not have to extend in the exact same direction. When the plurality of slits 120 extend in the same direction, the angle of the plurality of slits 120 relative to the first side portion 102 may be similar relative to the second side portion 104 to facilitate manufacturing. As shown, the fastener 100 has rotation symmetry of the plurality of slits 120 from the first side portion 102 to the second side portion 104.

FIG. 2*b* illustrates an example fastener 200*b* having a plurality of slits 120 extending along a first side portion 102 and a second side portion 104. The plurality of slits 120 extend in opposing directions. When the plurality of slits 120 extend in opposing directions, the angle of the plurality of slits 120 relative to the first side portion 102 is the same angle relative to the second side portion 104. The plurality of slits 120 on each side portion do not have to extend in the exact opposite direction.

FIG. 2*c* illustrates an example fastener 200*c* having a plurality of slits 120 extending along a first side portion 102 and a second side portion 104. The plurality of slits 120 extend perpendicular to each of the side portions toward, but not to, the mid-line of the fastener body 110. Although the plurality of slits 120 extend at the same height (measured from a first end 106), the plurality of slits 120 may extend as positioned offset from each other.

FIG. 2*d* illustrates an example fastener 200*d* having a plurality of slits 120 extending only along a first side portion 102. In the example shown, the plurality of slits 120 extend perpendicular from the side portion toward the mid-line of the fastener body 110. In a first embodiment, the plurality of slits 120 may extend beyond the mid-line of the fastener body 110. In another embodiment, the plurality of slits 120 may not extend to the mid-line of the fastener body 110.

Still further, the plurality of slits 120 are positioned generally equidistant from each other. Alternatively, the plurality of slits 120 may be positioned at different distances from each other.

Figure 3:
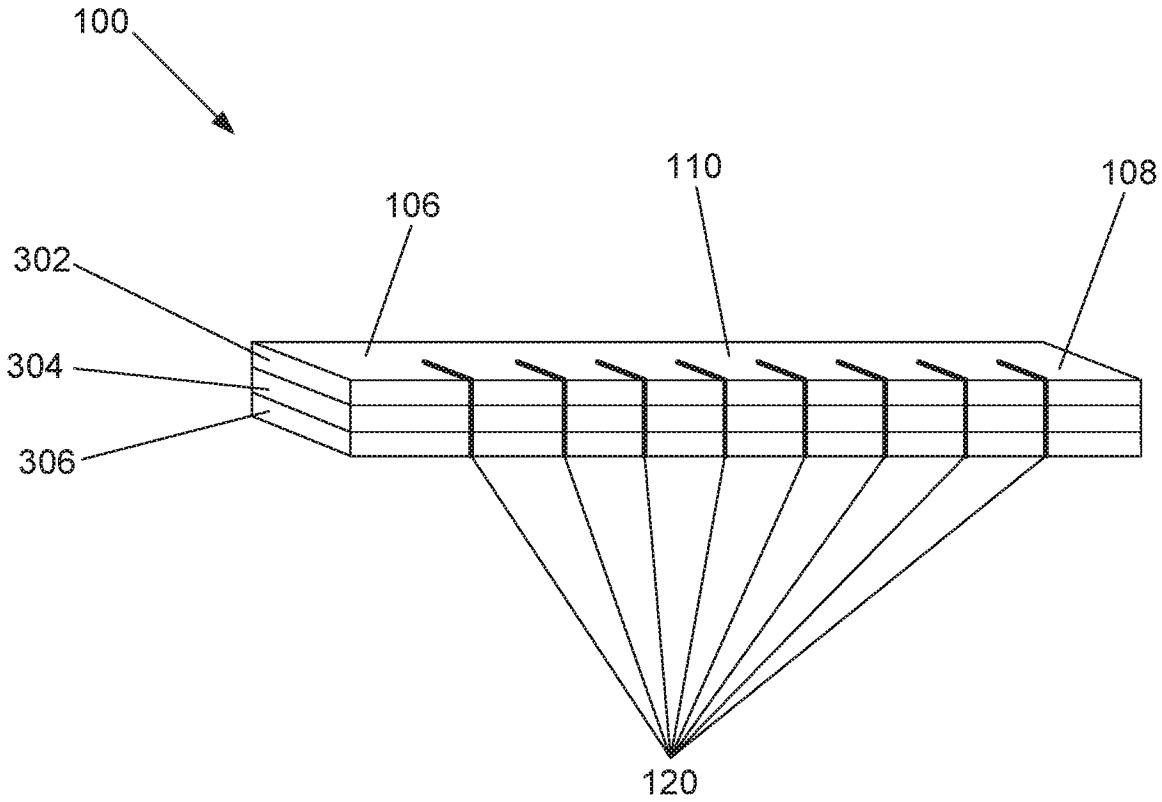
FIG. 3 illustrates another embodiment of a fastener having features that are examples of inventive aspects in accordance with the present disclosure.

FIG. 3 illustrates a perspective side view of an example fastener 100 that shows the details of the layers that might make up such as fastener 100. As shown, fastener 100 includes the first end 106, the second end 108, and the fastener body 110 extending therebetween. In the example shown, the fastener 100 includes three layers 302, 304, 306. It should be noted, however, that a fastener 100 may include only the second layer 304, or only a first layer 302 and a second layer 304. The plurality of slits 120 extends through all three layers 302, 304, 306. The fastener includes, at a minimum, the second layer 304.

In an embodiment that includes three layers, the first layer 302 and the third layer 306 may be made from the same material, while the second layer 304 is made from a different material. In an embodiment that includes two layers, the first layer 302 may be made from a material different from the second layer 304. The material forming the first layer 302 and the third layer 306 may be a paper material, and the material forming the second layer 304 may be a biocompatible and/or biodegradable material. Paper materials include, but are not limited to, paper, cardboard, and corn starch-based materials.

Biocompatible and/or biodegradable materials of the second layer 304 may be selected from bioplastics, such as aliphatic polyesters, polyanhydrides, polyvinyl alcohol, starch derivatives, cellulose esters, polyethylene derivatives, cellulose and starch, starch and glycerin, and other combinations of materials that are at a minimum, biocompatible. The material of the second layer 304 provides strength and mass to the fastener 100, so the fastener is strong enough to maintain a locked configuration and to not tear.

The first layer 302 may be adhered to the second layer 304 and the second layer 304 may be adhered to the third layer 306 with a biocompatible adhesive. Examples of biocompatible adhesives include food/starch based, protein based, or any PLA based mixtures.

Figure 4:
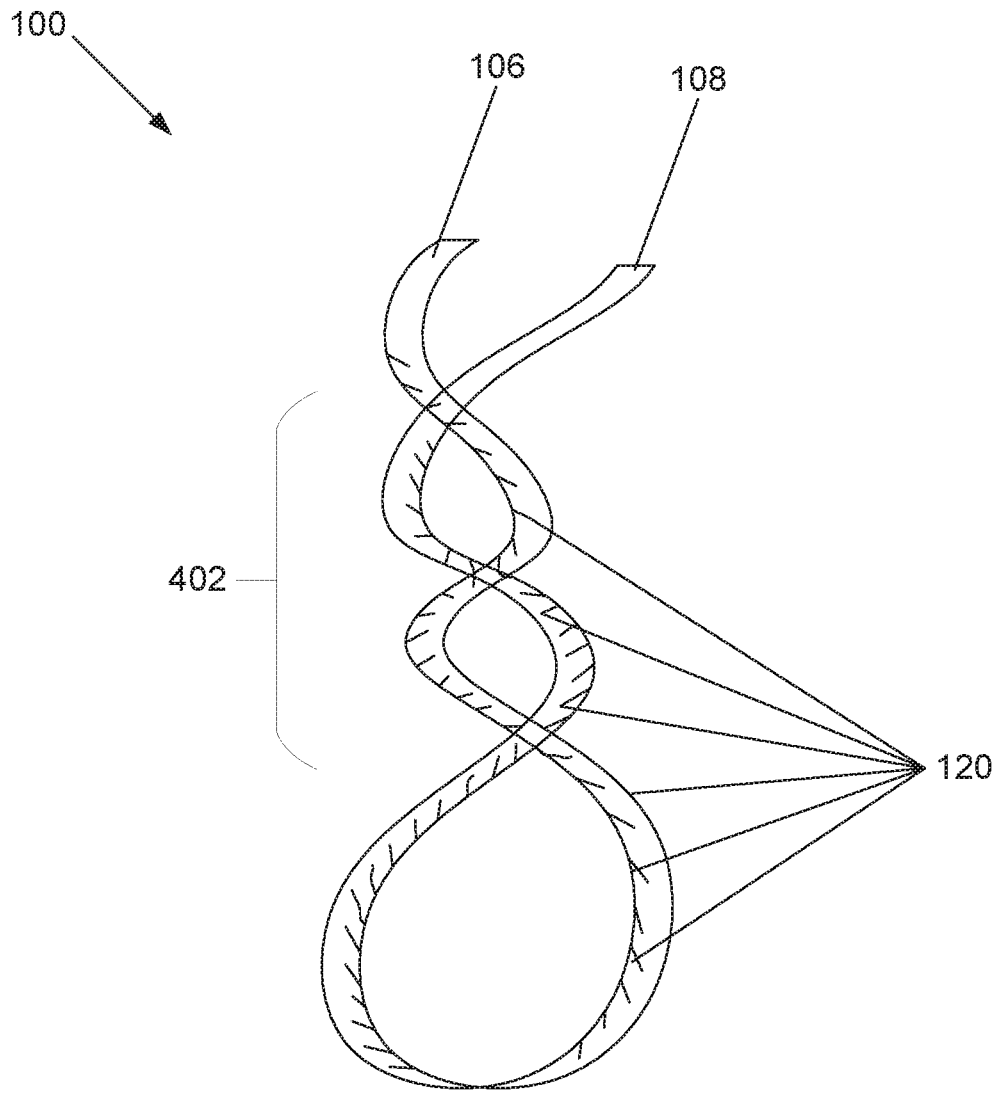
FIG. 4 illustrates an example embodiment of a fastener in a locking configuration.

FIG. 4 illustrates an example of the fastener 100 in a locked configuration. A locked configuration includes at least a portion of the length of the fastener body 110 twisted around itself. As shown, a locking portion 402 includes a portion of the fastener body 110 twisted around itself. The plurality of slits 120 catch each other, and maintain the fastener 100 in the locked configuration. The plurality of slits 120 become interlocked to each other, which maintains the temporary closure or seal of a bag.

Figure 5:
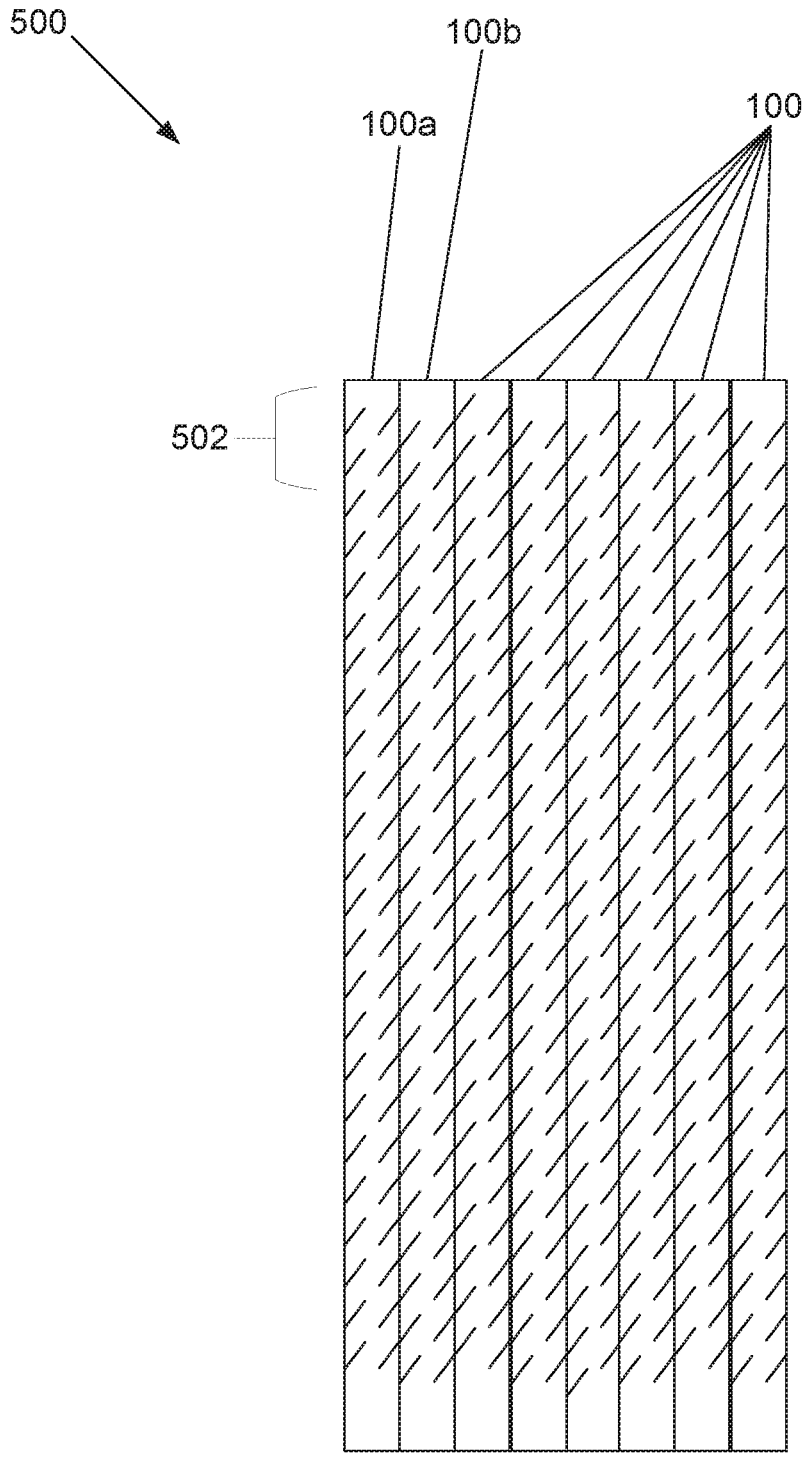
FIG. 5 illustrates an example embodiment of a fastener cluster formed from the fasteners of FIG. 1.

FIG. 5 illustrates a plurality of fasteners 100 connected together to form a sheet 500. A sheet 500 as used herein is defined as a collection of fasteners 100 of at least three across. As shown, a second side portion of a first fastener

100*a* is connected to a first side portion of an adjacent second fastener 100*b*. The first fastener 100*a* and the second fastener 100*b* may be removably connected to each other. For example, a removable connection may include providing perforations along the side portions of the fastener 100 or having only a portion of the side portions connected to each other. In an alternative embodiment, the first fastener and the second fastener are connected along only a portion of an end portion 502.

As shown in FIG. 5, for ease of manufacture, the plurality of slits 120 on a second side portion of a first fastener 100*a* line up with the plurality of slits 120 on a first side portion of a second fastener 100*b* and extend into both of the adjacent fasteners. However, as discussed above, other configurations of a plurality of slits 120 are envisioned.

The sheet 500 may have dimensions of about 4.75 inches high, 4.75 inches wide, and about 0.125 inch deep in one possible embodiment.

Figure 6:
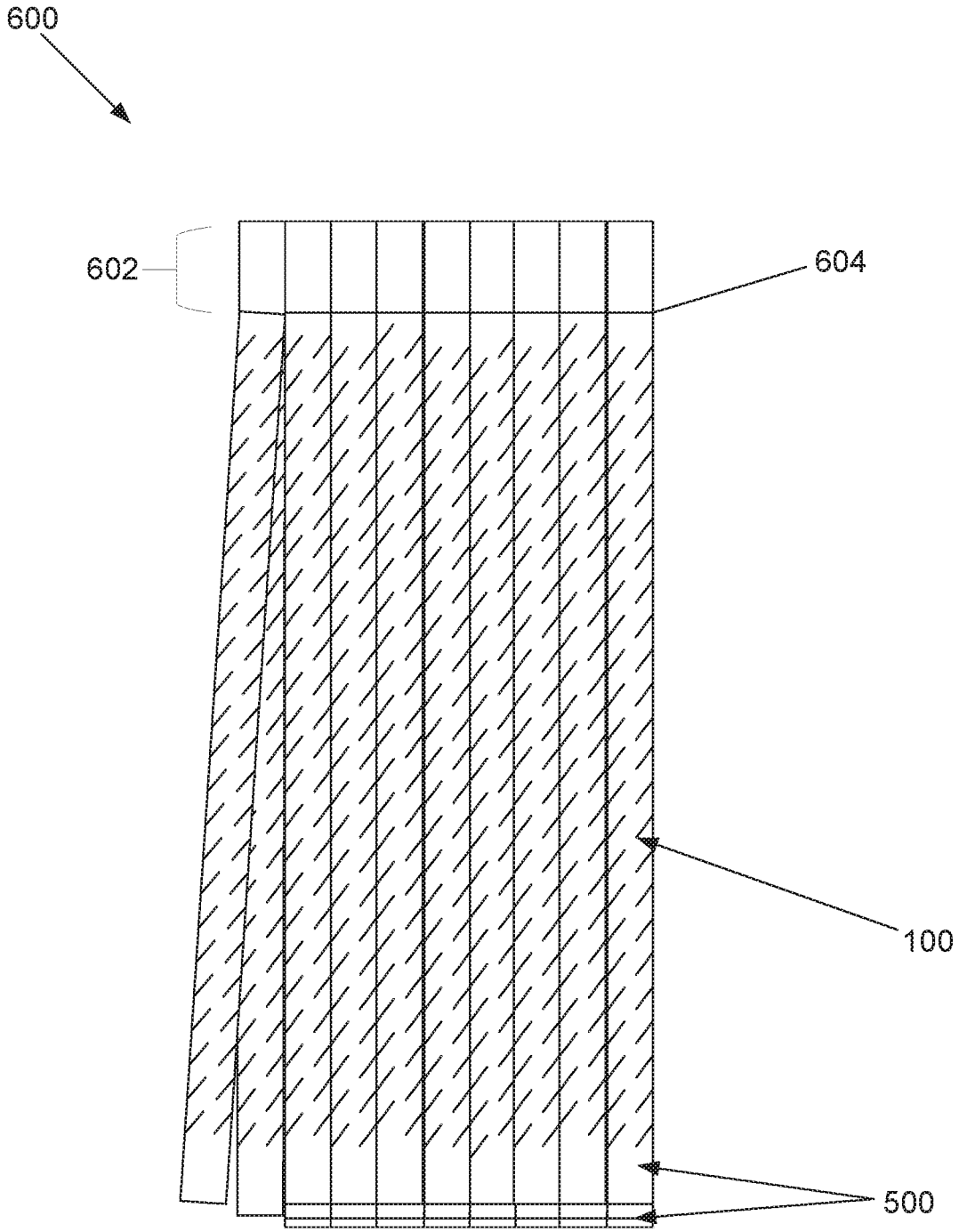
FIG. 6 illustrates an example of a fastener cluster configured to be fixed to a dispenser.

As shown in FIG. 6, a cluster 600 is shown. A cluster 600 is a plurality of sheets 500 of fasteners 100. In such an embodiment, the fastener cluster 600 may be provided with and/or attached to a dispenser (not shown) as an integral unit. The fastener cluster 600 may be attached to the dispenser in a variety of ways known in the art including via adhesives. Once the fasteners of the cluster are used and the entire cluster is spent, the entire dispenser, along with a top portion 602 of the cluster 600 that has adhesively been attached to the dispenser, can be disposed.

The fastener cluster 600 includes a plurality of fasteners 100 interconnected at a top portion 602 such as with an adhesive. The top portion 602 and the fastener 100 are separated by a perforation line 604, which allows for individual fasteners 100 to be easily separated from each other. In an embodiment where the fastener cluster 600 is provided in a dispenser, the perforation line 604 allows for individual fasteners 100 to be easily separated from the top portion 602.

In order to interconnect the sheets 500 of fasteners 100 into a cluster 600, the sheets 500 of fasteners 100 are clamped or held together in the region of the perforation line 604, and the top portions 602 thereof are interconnected. In the preferred embodiment, the means for interconnecting the top portion 602 of the fasteners 100 is a suitable adhesive which is applied thereto. Those skilled in the art will recognize alternatives (e.g., such as staples) may be used to connect sheets 500. In any case, the "weak link" in this arrangement is the perforation line 604, which allows the fastener body 110 of each fastener 100 to be removed from the cluster 600 by a user upon grasping the end of the fastener 100 and imparting a detaching force.

One preferred method for inter-connecting the top portion 602 of the fasteners is to apply adhesive by dipping the top portion 602 of a tightly clamped cluster of sheets 500 into a pool of hot melt adhesive. The end of the cluster is then removed from the adhesive and excess adhesive is allowed to drip off. One possible type of hot melt adhesive that may be used is Nacan Cool Lock Food Packaging Adhesive KHM-416, made by the National Starch & Chemical Company of Rampton, Ontario.

The cluster 600 is designed to fit within a fastener dispenser. Such a fastener dispenser is described in U.S. Pat. Nos. 6,217,500 and 5,232,431; the contents of which are incorporated by reference.

As shown, a plurality of fasteners may be arranged into a cluster 600. A method of arranging the cluster 600 of fasteners 100 includes the following steps. A sheet of fasteners comprising biocompatible material is provided. The sheet of fasteners is cut into parallel lines. Alternatively, the sheet of fasteners includes perforations that separate each fastener 100. The parallel lines are spaced apart to define a width of an elongate body of the fastener. A sheet 500 of fasteners 100 may have dimensions of about 4.75 inches high, 4.75 inches wide, and about 0.125 inch deep in one possible embodiment. The parallel lines are cut about 0.15625 inches apart from each other.

In an embodiment, a plurality of slits are cut along at least a first side portion of the elongate body of each of the fasteners. The slits are cut a sufficient distance from each other to maximize interlocking of slits onto themselves when twisted on an object, possibly 0.0125 inches apart from each other. Each of the slits extend at a predetermined angle relative to the parallel lines into the elongate body of each fastener. The slits do not extend past a mid-line of the elongate body. For example, each slit is about 0.05 inches long. The slits extend into the elongate body at a predetermined angle relative to the parallel lines. The predetermined angle may be 90 degrees, meaning that the angle is perpendicular to the first side portion. The predetermined angle may be less than 90 degrees, for example, 45 degrees relative to the first side portion.

In a further embodiment, a plurality of slits may be cut on a second side portion of the fastener. The slits could be cut 0.125 inches apart from each other. Each of the slits extend at a predetermined angle relative to the parallel lines into the elongate body of each fastener. The slits do not extend past a mid-line of the elongate body. For example, each slit is about 0.10 inches long. The slits extend into the elongate body at a predetermined angle relative to the parallel lines. The predetermined angle may be 90 degrees, meaning that the angle is perpendicular to the first side portion. The predetermined angle may be less than 90 degrees, for example, 45 degrees relative to the first side portion.

In an embodiment with a plurality of slits on both the first side portion and the second side portion, the plurality of slits may be cut at the same angle, or may be cut at opposing angles, such as a mirror image. Still further, the plurality of slits cut on a second side portion may be cut at an angle that is 90 degrees less the angle of the plurality of slits cut on the first side portion. This allows a single cut to be made that produces both the slits on a second side portion of a first fastener and on a first side portion of a second fastener.

The method of producing the sheet of fasteners may also include a step of placing the first end of the sheet in communication with an adhesive.

The method may also include a step of taking the sheet comprising biocompatible material and fusing it with a sheet of paper material. In a further embodiment, the method includes a step of taking the sheet comprising biocompatible material and fusing it on a first face to a paper material and fusing it on a second face to a paper material.

The sheet is made from biodegradable material selected from aliphatic polyesters, polyanhydrides, polyvinyl alcohol, starch derivatives, cellulose esters, polyethylene derivatives, cellulose and starch, and starch and glycerin.

The above specification, examples, and data provide a complete description of the manufacture and use of the composition of embodiments of the inventive aspects. Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the disclosure. Therefore, it is manifestly intended that the inventive features be limited only by the claims and the equivalents thereof.

The invention claimed is:

1. A fastener comprising:

an elongate body having a first side portion and a second side portion, the second side portion opposite the first side portion; and a plurality of discrete slits along the first side portion of the elongate body, the plurality of discrete slits extending at least partially into the elongate body of the fastener, wherein the fastener comprises a first layer and a second layer, the first layer comprising a biodegradable material and the second layer comprising a paper material.

2. The fastener of claim 1, wherein the elongate body further comprises the plurality of discrete slits along the second side portion of the elongate body, the plurality of discrete slits extending at least partially into the elongate body of the fastener.

3. The fastener of claim 1, wherein the plurality of slits extend in a direction perpendicular to a length of the elongate body.

4. The fastener of claim 1, wherein the plurality of slits extend at an angle greater than 0 degrees but less than 90 degrees to a length of the elongate body.

5. The fastener of claim 1, wherein the biodegradable material is selected from aliphatic polyesters, polyanhydrides, polyvinyl alcohol, starch derivatives, cellulose esters, polyethylene derivatives, cellulose and starch, and starch and glycerin.

6. The fastener of claim 1, wherein the fastener comprises the first layer comprising the biodegradable material, the second layer comprising the paper material, and a third layer comprising the paper material, wherein the first layer comprising the biodegradable material is located between the second layer and the third layer that comprise the paper material.

7. The fastener of claim 1, wherein the elongate body does not comprise a malleable material.

8. A cluster of fasteners comprising:

a plurality of fasteners defining the cluster, each of the fasteners comprising:

an elongate body having a first side portion and a second side portion, the second side portion opposite the first side portion; and a plurality of discrete slits along the first side portion of the elongate body, the plurality of discrete slits extending at least partially into the elongate body of the fastener;

wherein each of the plurality of fasteners is connected at a first end, and wherein each of the fasteners comprises a first layer and a second layer, the first layer comprising a biodegradable material and the second layer comprising a paper material.

9. The cluster of fasteners of claim 8, wherein the elongate body of each of the fasteners further comprises the plurality of discrete slits along the second side portion of the elongate body, the plurality of discrete slits extending at least partially into the elongate body of each of the fasteners.

10. The cluster of fasteners of claim 9, wherein the plurality of slits extend in a direction perpendicular to a length of the elongate body of each of the fasteners.

11. The cluster of fasteners of claim 9, wherein the plurality of slits extend at an angle greater than 0 degrees but less than 90 degrees to a length of the elongate body of each of the fasteners.

12. The cluster of fasteners of claim 8, wherein the biodegradable material is selected from aliphatic polyesters, polyanhydrides, polyvinyl alcohol, starch derivatives, cellulose esters, polyethylene derivatives, cellulose and starch, and starch and glycerin.

13. The cluster of fasteners of claim 8, wherein each of the fasteners comprises the first layer comprising the biodegradable material, the second layer comprising the paper material, and a third layer comprising the paper material, wherein the first layer comprising the biodegradable material is located between the second layer and the third layer that comprise the paper material.

14. The cluster of fasteners of claim 8, wherein the elongate body of each of the fasteners does not comprise a malleable material.

* * * * *